US008388120B2

(12) United States Patent
Shin et al.

(10) Patent No.: US 8,388,120 B2
(45) Date of Patent: Mar. 5, 2013

(54) INTEGRATED APPARATUS FOR SUPPLYING INK AND REGULATING PRESSURE

(75) Inventors: Dong-Youn Shin, Daejeon (KR); Jun-Hee Lee, Daejeon (KR); Su-A Park, Daejeon (KR); Joon-Sik Park, Daejeon (KR); Wan-Doo Kim, Daejeon (KR)

(73) Assignee: Korea Institute of Machinery and Materials, Daejeon (KR)

( * ) Notice: Subject to any disclaimer, the term of this patent is extended or adjusted under 35 U.S.C. 154(b) by 280 days.

(21) Appl. No.: 12/786,595

(22) Filed: May 25, 2010

(65) Prior Publication Data

US 2010/0302325 A1 Dec. 2, 2010

(30) Foreign Application Priority Data

Jun. 1, 2009 (KR) ..... 10-2009-0048189

(51) Int. Cl.
*B41J 2/175* (2006.01)

(52) U.S. Cl. ..... 347/85

(58) Field of Classification Search ..... 347/85, 347/86, 87, 7
See application file for complete search history.

(56) References Cited

U.S. PATENT DOCUMENTS 4,138,687 A * 2/1979 Cha et al. ..... 347/75
4,998,116 A * 3/1991 Regnault ..... 347/6
5,886,718 A * 3/1999 Johnson et al. ..... 347/85
5,889,543 A * 3/1999 Miyazawa et al. ..... 347/86
6,428,152 B1 * 8/2002 Hollands ..... 347/85
6,908,165 B2 * 6/2005 Pinard ..... 347/7
7,874,656 B2 * 1/2011 Ota et al. ..... 347/85

FOREIGN PATENT DOCUMENTS

JP 06-15838 * 1/1994 ..... 347/86
KR 10 0374593 3/2003
KR 10 0715448 5/2007

* cited by examiner

*Primary Examiner* — Huan Tran
(74) *Attorney, Agent, or Firm* — Dority & Manning, P.A.

(57) ABSTRACT

Disclosed is an integrated apparatus for supplying ink and regulating pressure, which comprises a chamber accommodating ink, a main chamber preliminarily storing ink to be supplied to the chamber, a nozzle communicating with the chamber and jetting ink transferred from the chamber to an outside, a first valve blocking or letting flow of ink between the main chamber and the chamber, a second valve blocking and letting flow of ink between the chamber and the nozzle, a piston placed above ink accommodated in the chamber and reciprocating rectilinearly while sealing ink inside the chamber, a piston driver providing a driving force to the piston, a sensor installed in the chamber and sensing pressure due to weight of ink, and a controller receiving a sensed signal from the sensor and outputting a signal for controlling the piston to the piston, wherein the piston moves down as a level of ink accommodated in the chamber is lowered when ink is discharged to the outside through the nozzle, and the piston moves up and the first valve and the second valve are respectively opened and closed when ink is filled in the chamber.

9 Claims, 4 Drawing Sheets

INTEGRATED APPARATUS FOR SUPPLYING INK AND REGULATING PRESSURE

CROSS-REFERENCE TO RELATED APPLICATION

This application claims priority to and the benefit of Korean Patent Application No. 10-2009-0048189 filed in the Korean Intellectual Property Office on Jun. 1, 2009, the entire contents of which are incorporated herein by reference.

BACKGROUND OF THE INVENTION (a) Field of the Invention

The present invention relates to an integrated apparatus for supplying ink and regulating pressure, and more particularly, to an integrated apparatus for supplying ink and regulating pressure, in which proper negative pressure can be kept in a chamber accommodating the ink to stably form a meniscus in a nozzle.

(b) Description of the Related Art

In general, an inkjet printer is an apparatus that prints an image with predetermined colors by discharging a minute droplet of ink to a desired position on recording paper. The inkjet printer is provided with an ink transfer system for discharging the ink. The ink transfer system is broadly classified into two types according to methods of discharging the ink. One is a thermal driving type that uses a heat source to generate bubbles in ink and discharges the ink by the expansive force of the bubbles. The other one is a piezoelectric type that uses transformation of a piezoelectric body to discharge ink by pressure applied due to the transformation.

FIG. 1 is a schematic view showing an example of a conventional ink transfer system.

Referring to FIG. 1, an ink transfer system includes a main chamber 10 preliminarily accommodating a large amount of ink 1, a remote chamber 20 accommodating the ink 1 to be used in a printing job, and a nozzle 30 communicating with the remote chamber 20 and jetting the ink transferred from the remote chamber 20 to the outside. The ink 1 is transferred from the main chamber 10 to the remote chamber 20 via a control valve 12 and a filter 24. The amount of ink 1 accommodated in the remote chamber 20 is sensed by a level sensor 22 installed in the remote chamber 20 so that the amount of ink 1 transferred from the main chamber 10 to the remote chamber 20 can be controlled.

Even while the printing job is not performed, the ink 1 is remained in the remote chamber 20, the nozzle 30 and a channel 26 connected between the remote chamber 20 and the nozzle 30. To prevent the ink 1 in the nozzle 30 from being discharged to the outside while the printing job is not performed, the remote chamber 20 has to internally keep negative pressure lower than the atmospheric pressure. To this end, a vacuum pump 40 or the like is connected to the remote chamber 20 and keeps the remote chamber 20 in the negative pressure lower than the atmospheric pressure.

However, the conventional ink transfer system additionally needs the vacuum pump or the like for keeping the remote chamber in the negative pressure, so that it is inconvenient to separately install the additional device. Further, vibration generated when the vacuum pump operates is transmitted to the system, so that there is a problem in precisely controlling the discharge of the ink. Also, the vacuum pump is so distant from the remote chamber that a problem arises in response time delay. Furthermore, a separate pump is needed to supply ink from the main chamber to the remote chamber.

SUMMARY OF THE INVENTION

Accordingly, the present invention is conceived to solve the foregoing problems, and an aspect of the present invention is to provide an integrated apparatus for supplying ink and regulating pressure, in which a piston is directly installed in a chamber to keep the chamber in negative pressure, thereby efficiently controlling the negative pressure inside the chamber in real time and easily supplying the ink from an outside to an inside of a chamber.

An exemplary embodiment of the present invention provides an integrated apparatus for supplying ink and regulating pressure, which comprises a chamber accommodating ink, a main chamber preliminarily storing ink to be supplied to the chamber, a nozzle communicating with the chamber and jetting ink transferred from the chamber to an outside, a first valve blocking or letting flow of ink between the main chamber and the chamber, a second valve blocking and letting flow of ink between the chamber and the nozzle, a piston placed above ink accommodated in the chamber and reciprocating rectilinearly while sealing ink inside the chamber, a piston driver providing a driving force to the piston, a sensor installed in the chamber and sensing pressure due to weight of ink, and a controller receiving a sensed signal from the sensor and outputting a signal for controlling the piston to the piston, wherein the piston moves down as a level of ink accommodated in the chamber is lowered when ink is discharged to the outside through the nozzle, and the piston moves up and the first valve and the second valve are respectively opened and closed when ink is filled in the chamber.

The piston may move down as a level of ink accommodated in the chamber is lowered while being spaced from a top surface of ink accommodated in the chamber.

The piston may comprise a facing unit that faces ink, the facing unit comprising a horizontal part formed substantially parallel with a top surface of ink, and a protruding part formed protruding from the horizontal part toward ink.

The integrated apparatus may further comprise an ink inlet through which the chamber is filled with ink supplied from the main chamber, wherein the ink inlet is placed below the piston in the chamber.

The sensor may be installed on a bottom surface of the chamber.

DETAILED DESCRIPTION OF THE EMBODIMENTS

Hereinafter, exemplary embodiments of an apparatus for supplying ink and regulating pressure according to the present invention will be described with reference to accompanying drawings.

Figure 1:
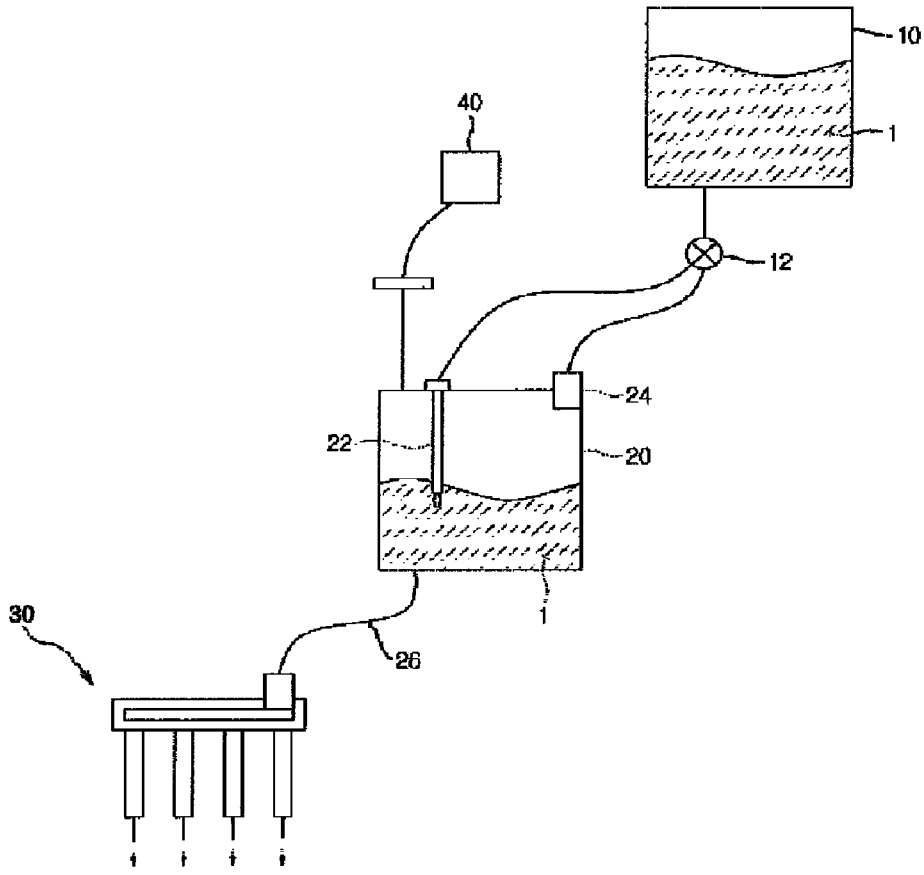
FIG. 1 is a schematic view showing an example of a conventional ink transfer system.
Figure 2:
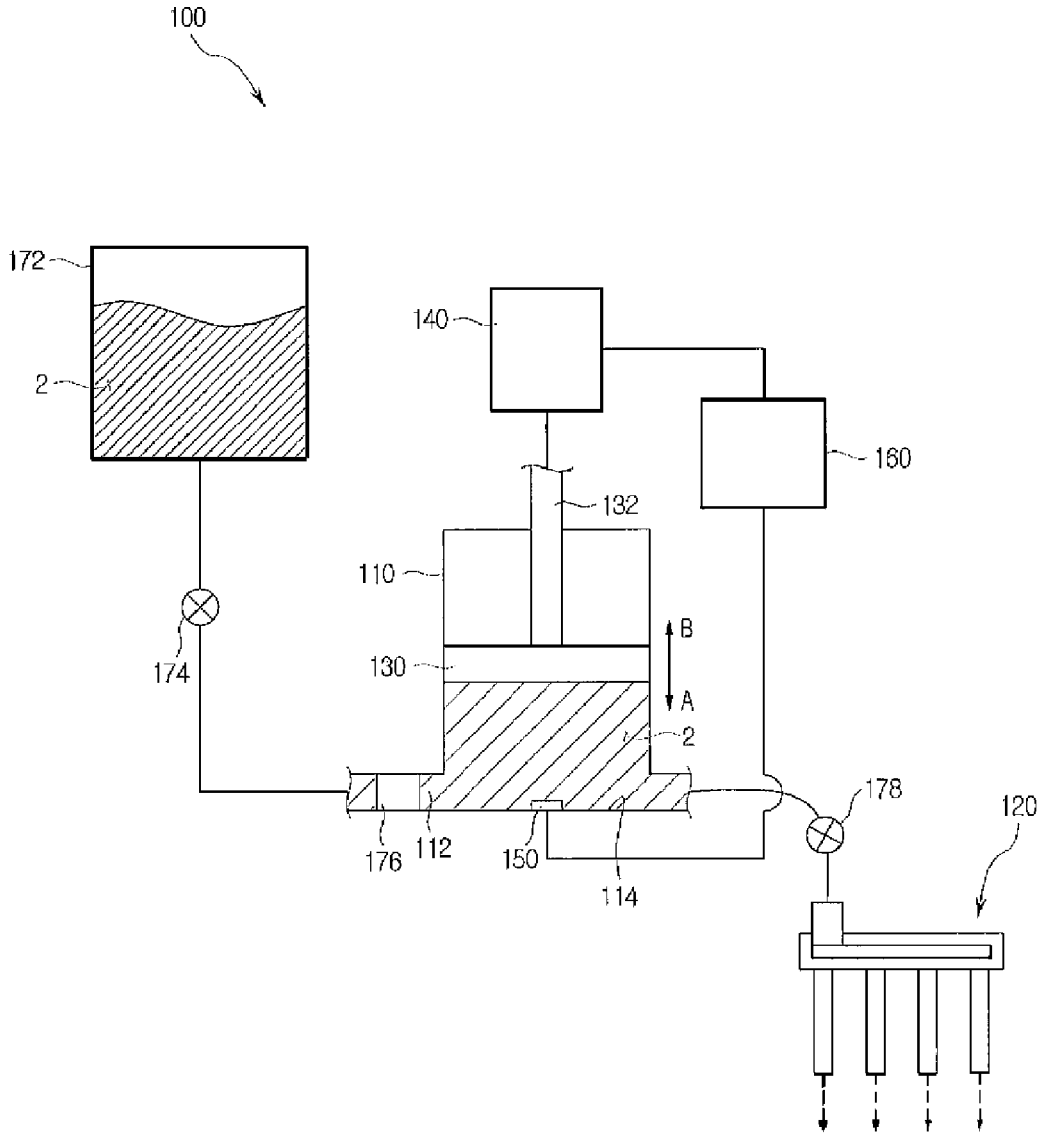
FIG. 2 is a schematic view showing an integrated apparatus for supplying ink and regulating pressure according to a first exemplary embodiment of the present invention.

FIG. 2 is a schematic view showing an integrated apparatus for supplying ink and regulating pressure according to a first exemplary embodiment of the present invention.

Referring to FIG. 2, an integrated apparatus 100 for supplying ink and regulating pressure in this exemplary embodiment uses a piston as a means for keeping an inside of a chamber in negative pressure and supplying the ink to the inside of the chamber, which includes a chamber 110, a main chamber 172, a nozzle 120, a first valve 174, a second valve 178, a piston 130, a piston driver 140, a sensor 150, and a controller 160.

The chamber 110 accommodates ink 2. The chamber 110 communicates with the main chamber 172 preliminarily storing the ink 2 to be filled in the chamber 110 if the chamber 110 lacks the ink 2, and the amount of ink 2 transferred from the main chamber 172 to the chamber 110 is adjusted by the first valve 174 installed on a channel connected between the main chamber 172 and the chamber 110.

The first valve 174 blocks or let the flow of ink between the main chamber 174 and the chamber 110. The ink 2 passed by the first valve 174 experiences the filter 176 before being introduced into the chamber 110, so that impurities can be removed from the ink 2.

To fill the inside of the chamber 110 with the ink 2, the chamber 110 is provided with an ink inlet 112 through which the ink 2 supplied from an exterior, particularly, from the main chamber 172 is provided to the chamber 110. In this exemplary embodiment, the ink inlet 112 may be formed in a lateral wall or a bottom surface of the chamber 110. For example, to maintain sealing between the piston 130 and the chamber 110, the ink inlet 112 may be placed on the lateral wall of the chamber 110 below the piston 130.

The nozzle 120 communicates with the chamber 110 and jets the ink 2 transferred from the chamber 110 to the outside. While the operation of jetting the ink is not performed, the ink 2 is remained in the chamber 110, the nozzle 120 and a channel connected between the chamber 110 and the nozzle 120, and the ink 2 in the nozzle 120 at a part being in contact with external air has a meniscus shape, i.e., an inwardly curved shape.

The second valve 178 blocks or lets the flow of ink between the chamber 170 and the nozzle 120.

The piston 130 is placed above the ink 2 accommodated in the chamber 110 and seals the ink 2 inside the chamber 110. The piston 130 can rectilinearly reciprocate in a vertical direction along an inner wall of the chamber 110 while being in nearly contact with a top surface of the ink 2 accommodated in the chamber 110.

The piston driver 140 gives a driving force to the piston 130 so that the piston 130 can rectilinearly reciprocate in the vertical direction. In this exemplary embodiment, the piston driver 140 includes a linear motor providing a linear driving force, and a linear moving guide connected to a rod 132 of the piston 130 and guiding the piston 130 to move rectilinearly. Combination of the linear motor and the linear moving guide to achieve the rectilinear movement of the piston 130 is well known to a person having an ordinary skill in the art, and thus repetitive descriptions thereof will be avoided. Alternatively, the piston driver 140 may be achieved by combination of a rotation motor providing a rotation driving force, a ball screw, and a linear moving guide.

The sensor 150 is installed in the chamber 110 and senses pressure due to the weight of the ink 2. The pressure of the ink 2 accommodated in the chamber 110 varies depending on ink levels, which calculated as follows.

$$p=\rho gh$$

where, p indicates the pressure based on the weight of the ink 2, ρ indicates the density of the accommodated ink 2, g indicates the acceleration of gravity, and h indicates a level from a bottom surface 114 of the chamber 110 to the top surface of the ink 2.

As the ink 2 is discharged to the outside through the nozzle 120, the amount of ink 2 in the chamber 110 decreases and thus the level of the ink 2 in the chamber 110 is lowered. If the level of the ink 2 is lowered, the pressure due to the weight of the ink 2 decreases and the sensor 150 senses such a change in the pressure. In this exemplary embodiment, the sensor 150 is installed on the bottom surface 114 of the chamber 110. Alternatively, the sensor 150 may be installed on the lateral wall adjacent to the bottom surface 114 of the chamber 110.

The controller 160 receives a sensed signal from the sensor 150 and outputs a control signal to the piston driver 140 so as to control the piston 130. That is, the controller 160 controls the piston driver 140 to move the piston 130 down on the basis of the sensed signal received from the sensor 150 that senses a lowered level of the ink 2 accommodated in the chamber 110. if the ink 2 is discharged to the outside through the nozzle 120, the level of the ink 2 accommodated in the chamber 110 is lowered, and the sensor 150 senses corresponding decrease of the pressure. The sensed signal is input to the controller 160, and the controller 160 outputs the control signal for controlling the piston driver 140 to move the piston 130 down.

In this exemplary embodiment configured as described above, an operating principle of the integrated apparatus for supplying the ink and regulating the pressure will be schematically described with reference to FIG. 2.

First, if the ink 20 starts being discharged to the outside through the nozzle 120 at the operation of jetting the ink 2, the amount of ink 2 accommodated in the chamber 110 is reduced and the level of the ink 2 in the chamber 110 is lowered. As the level of the ink 2 is lowered, the pressure due to the weight of the ink 2 is decreased and the sensor 150 installed on the bottom surface 114 of the chamber 110 senses such a pressure change in real time.

A signal of pressure sensed by the sensor 150 is input to the controller 160, and the controller 160 outputs a signal for controlling the piston driver 140 so as to move the piston 130 down (in a direction of "A"). At this time, a moving-down speed of the piston 130 is controlled to maintain a state that the piston 130 is not dipped into the ink 2 and there is no airspace between the piston 130 and the ink 2, that is, a state that the piston 130 and the top surface of the ink 2 are in nearly contact with each other.

In the state that the down movement of the piston 130 is controlled depending on the level of the ink 2 accommodated in the chamber 110, if the operation of outwardly jetting the ink is stopped, the inside of the chamber 110 accommodating the ink 2 is kept in negative pressure lower than the atmospheric pressure of the outside. Thus, the ink 2 inside the nozzle 120 is not outwardly discharged any more and has a stable meniscus in a boundary where the nozzle 120 meets the outside. This is based on the same principle that no more injection is discharged to the outside of a cylinder when a piston stops moving in a syringe having the cylinder and the piston.

Meanwhile, if the ink 2 in the chamber 110 is used up and there is a need of filling the chamber 110 with the ink 2, the second valve 178 is first closed not to have an effect on the ink 2 remained in the nozzle 120 and the channel connected between the chamber 110 and the nozzle 120, thereby blocking the flow of the ink 2 between the chamber 110 and the nozzle 120. Next, the first valve 174 placed between the main chamber 172 and the chamber 110 is opened to let the ink flow between the main chamber 172 and the chamber 110. Then, the piston driver 140 drives the piston 130 to move up (in a direction of "B"), so that the ink 2 remained in the main chamber 172 can be transferred to the inside of the chamber 110.

In the integrated apparatus for supplying ink and regulating pressure, configured as described above according to an exemplary embodiment of the present invention, the piston directly installed inside the chamber is used to keep the inside of the chamber in the negative pressure and to supply the ink to the inside of the chamber if necessary, and it is thus effective in simplifying the whole system.

Also, in the integrated apparatus for supplying ink and regulating pressure, configured as described above according to an exemplary embodiment of the present invention, a vacuum pump for keeping the inside of the chamber in the negative pressure, a pump for supplying the ink to the inside of the chamber, etc. are not used to thereby isolate vibration to be transmitted to the system and thus precisely control the discharge of the ink.

Further, in the integrated apparatus for supplying ink and regulating pressure, configured as described above according to an exemplary embodiment of the present invention, the piston installed inside the chamber is employed instead of the vacuum pump installed distantly from the chamber, thereby quickly responding to change in a level of the ink.

Figure 3:
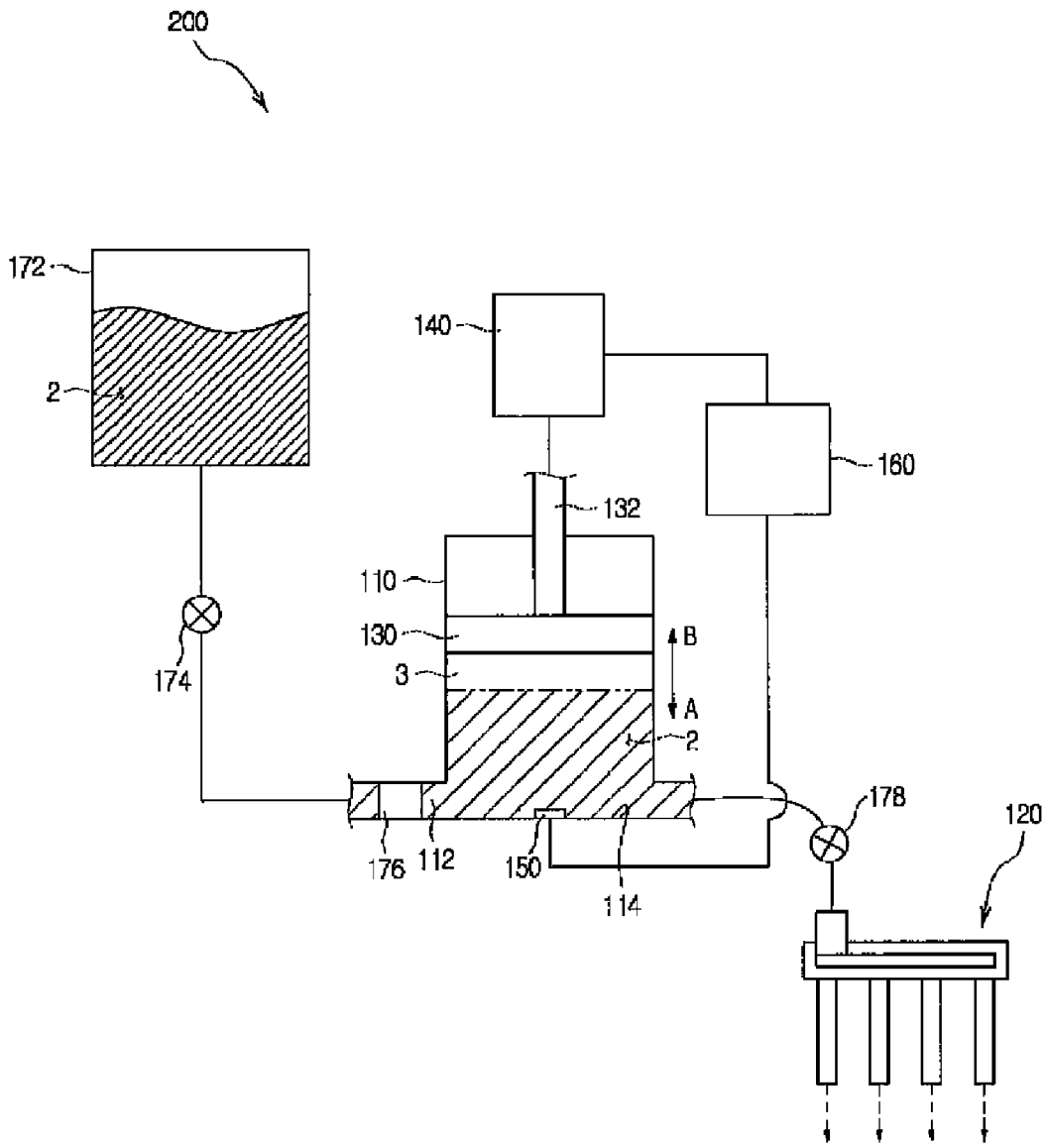
FIG. 3 is a schematic view showing an integrated apparatus for supplying ink and regulating pressure according to a second exemplary embodiment of the present invention.

FIG. 3 is a schematic view showing an integrated apparatus for supplying ink and regulating pressure according to a second exemplary embodiment of the present invention.

In FIG. 3, numerals similar to those shown in FIG. 2 refer to elements having similar structures and functions, and thus repetitive descriptions thereof will be avoided.

Referring to FIG. 3, an integrated apparatus 200 for supplying ink and regulating pressure in this exemplary embodiment is characterized in that the piston 130 moves down corresponding to a lowered level of the ink while being spaced apart from the top surface of the ink 2 accommodated in the chamber 110.

Since the fluid ink 2 is generally incompressible, a volume change of the ink 2 inside the chamber 110 directly affects the amount of ink discharged to the outside through the nozzle 120. Therefore, if the piston 130 repeatedly reciprocates in the state that the piston 130 and the top surface of the ink 2 are in nearly contact with each other like the first exemplary embodiment, even a little error generated in the up and down movement of the piston 130 directly makes an abnormal amount of ink 2 be discharged to the outside through the nozzle 120 and causes an object, onto which the ink 2 is applied, to be defective.

Accordingly, an airspace 3 having a certain thickness is provided between the ink 2 and the piston 130, and it is controlled that the airspace 3 is maintained constantly when the piston 130 moves down as the level of the ink 2 is lowered. In other words, the gaseous airspace 3 provided between the ink 2 and the piston 130 serves as a kind of buffer.

In the integrated apparatus for supplying ink and regulating pressure, configured as described above according to an exemplary embodiment of the present invention, there is provided the airspace capable of decreasing an error that may occur while the piston moves and functioning as a kind of buffer, thereby preventing an abnormal amount of ink from being discharged when jetting the ink.

Figure 4:
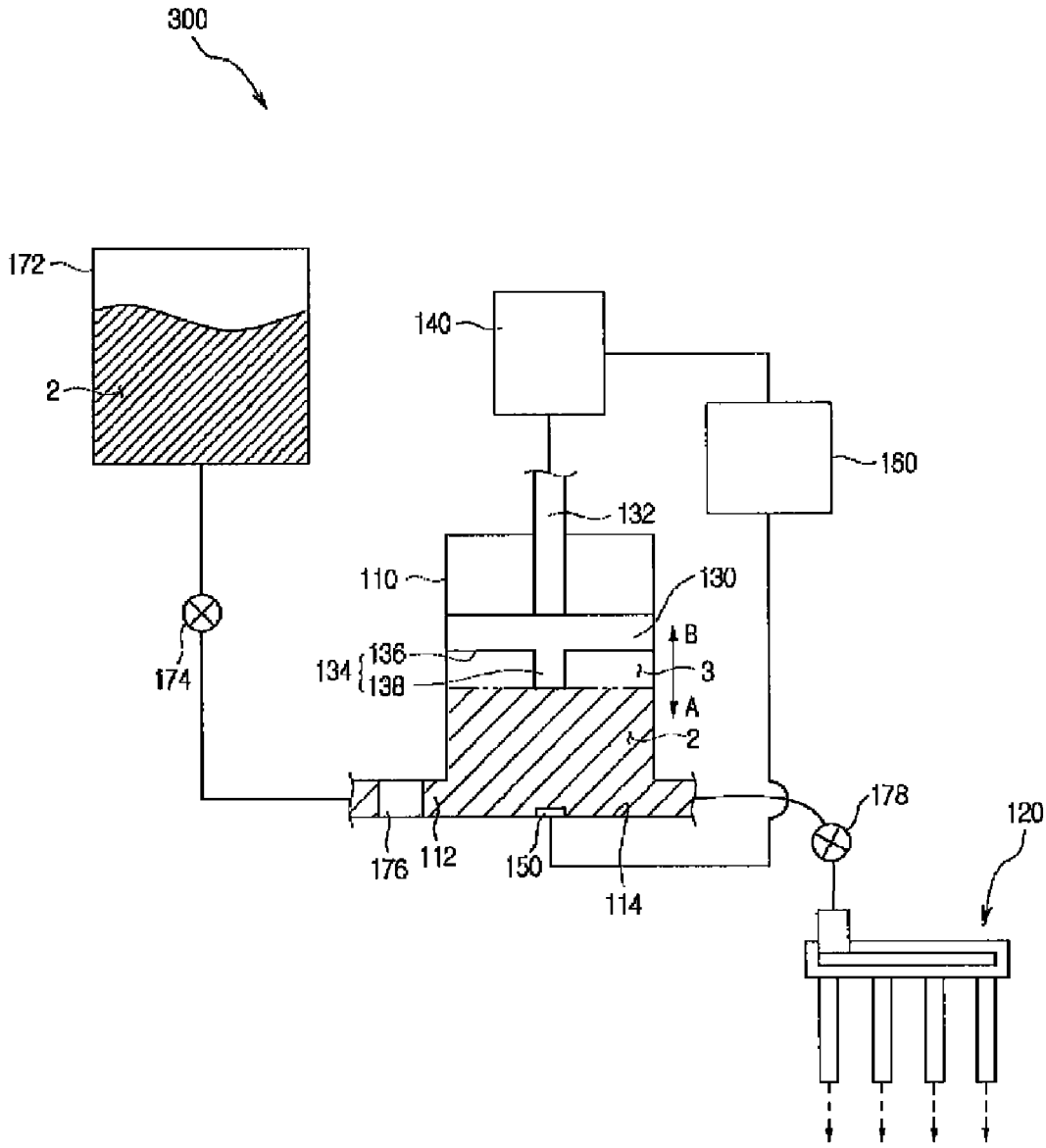
FIG. 4 is a schematic view showing an integrated apparatus for supplying ink and regulating pressure according to a third exemplary embodiment of the present invention.

FIG. 4 is a schematic view showing an integrated apparatus for supplying ink and regulating pressure according to a third exemplary embodiment of the present invention.

In FIG. 4, numerals similar to those shown in FIG. 2 refer to elements having similar structures and functions, and thus repetitive descriptions thereof will be avoided.

Referring to FIG. 4, an integrated apparatus 300 for supplying ink and regulating pressure in this exemplary embodiment is characterized in that the piston 130 includes a facing unit 134 facing the ink 2, the facing unit 134 having a horizontal part 136 formed substantially parallel with the top surface of the ink 2 and a protruding part 138 protruding from the horizontal part 136 toward the ink 2.

In this exemplary embodiment, the piston 130 moves down inside the chamber 110 while an end part of the protruding part 138 is kept in nearly contact with the top surface of the ink 2. Also, the airspace 3 is formed around the protruding part 138 between the horizontal part 136 and the top surface of the ink 2, and serves as a kind of buffer like that according to the second exemplary embodiment of the present invention. Although malfunction due to the contact between the protruding part 138 and the ink 2 when jetting the ink may cause the ink to be excessively discharged, an area of the contact is minimized to thereby have a minimum effect on the amount of ink discharged through the nozzle 120.

As described above, according to an exemplary embodiment of the present invention, there is provided an integrated apparatus for supplying ink and regulating pressure, which uses a piston directly installed inside a chamber to keep an inside of the chamber in negative pressure and to supply ink from an outside to the inside of the chamber, thereby simplifying the system.

Also, according to an exemplary embodiment of the present invention, there is provided an integrated apparatus for supplying ink and regulating pressure, which does not use a vacuum pump for keeping the inside of the chamber in the negative pressure or a pump for supplying ink to the inside the chamber, thereby isolating vibration to be transmitted to the system and thus precisely controlling discharge of ink.

Further, according to an exemplary embodiment of the present invention, there is provided an integrated apparatus for supplying ink and regulating pressure, which employs the piston installed inside the chamber instead of the is vacuum pump installed distantly from the chamber, thereby quickly responding to change in a level of the ink.

Furthermore, according to an exemplary embodiment of the present invention, there is provided an integrated apparatus for supplying ink and regulating pressure, which moves the piston with an airspace between the piston and the ink, thereby preventing the ink from being excessively jetted or the like due to malfunction of the piston when jetting the ink.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An integrated apparatus for supplying ink and regulating pressure, which comprises a chamber accommodating ink, a main chamber preliminarily storing ink to be supplied to the chamber, a nozzle communicating with the chamber and jetting ink transferred from the chamber to an outside, a first valve blocking or letting flow of ink between the main chamber and the chamber, a second valve blocking and letting flow of ink between the chamber and the nozzle, a piston placed above ink accommodated in the chamber and reciprocating rectilinearly while sealing ink inside the chamber, a piston driver providing a driving force to the piston, a sensor installed in the chamber and sensing pressure due to weight of ink, and a controller receiving a sensed signal from the sensor and outputting a signal for controlling the piston to the piston, the piston moving down as a level of ink accommodated in the chamber is lowered when ink is discharged to the outside through the nozzle, and the piston moving up and the first valve and the second valve being respectively opened and closed when ink is filled in the chamber.

2. The integrated apparatus according to claim 1, wherein the piston moves down as a level of ink accommodated in the chamber is lowered while being spaced from a top surface of ink accommodated in the chamber.

3. The integrated apparatus according to claim 1, wherein the piston comprises a facing unit that faces ink, and the facing unit comprises a horizontal part formed substantially parallel with a top surface of ink, and a protruding part formed protruding from the horizontal part toward ink.

4. The integrated apparatus according to claim 1, further comprising an ink inlet through which the chamber is filled with ink supplied from the main chamber, wherein the ink inlet is placed below the piston in the chamber.

5. The integrated apparatus according to claim 2, further comprising an ink inlet through which the chamber is filled with ink supplied from the main chamber, wherein the ink inlet is placed below the piston in the chamber.

6. The integrated apparatus according to claim 3, further comprising an ink inlet through which the chamber is filled with ink supplied from the main chamber, wherein the ink inlet is placed below the piston in the chamber.

7. The integrated apparatus according to claim 1, wherein the sensor is installed on a bottom surface of the chamber.

8. The integrated apparatus according to claim 2, wherein the sensor is installed on a bottom surface of the chamber.

9. The integrated apparatus according to claim 3, wherein the sensor is installed on a bottom surface of the chamber.

* * * * *